United States Patent [19]

Girard et al.

[11] Patent Number: 4,949,418

[45] Date of Patent: Aug. 21, 1990

[54] CHIMNEY CLEANING APPARATUS

[75] Inventors: Frank Girard; Raymond Russell; George Hostland, all of Gibsons, Canada

[73] Assignee: Wiz Innovations, Inc., Gibsons, Canada

[21] Appl. No.: 310,206

[22] Filed: Feb. 9, 1989

[30] Foreign Application Priority Data

Feb. 12, 1988 [CA] Canada ..... 558825

[51] Int. Cl.[5] ..... F23J 3/02

[52] U.S. Cl. ..... 15/242; 15/162

[58] Field of Search ..... 15/242, 243, 162, 163, 15/249

[56] References Cited

U.S. PATENT DOCUMENTS

| | | | |
|---|---|---|---|
| 195,445 | 9/1877 | Dickerson . | |
| 1,230,310 | 6/1917 | MacDonald | 15/242 |
| 1,392,202 | 9/1921 | Nechville . | |
| 1,582,309 | 4/1926 | Satterberg . | |
| 1,615,733 | 1/1927 | Wold . | |
| 2,455,001 | 11/1948 | Fortin | 15/243 |
| 4,090,271 | 5/1978 | Piontkowski | 15/243 |
| 4,319,378 | 3/1982 | Bowman et al. | 15/242 X |
| 4,333,200 | 6/1982 | Thurow | 15/243 |
| 4,490,879 | 1/1985 | Colby | 15/242 |
| 4,492,000 | 1/1985 | Skogen | 15/242 |
| 4,498,212 | 2/1985 | Davis | 15/242 |
| 4,625,358 | 12/1986 | Barrett | 15/242 |

*Primary Examiner*—Chris K. Moore

*Attorney, Agent, or Firm*—Spensley Horn Jubas & Lubitz

[57] ABSTRACT

This invention is directed to a novel apparatus which can be used for cleaning the interiors of fouled chimneys. More particularly, this novel apparatus can be adjusted to fit the interiors of various chimney sizes. The apparatus cleans not only soot but also tar and creosote from the interior of the chimney. The device for cleaning the interior of a chimney comprises: (a) a scraper for contacting and scraping the side of the chimney; (b) a constant angle contact member for contacting the side of the chimney at a constant angle; (c) a member for contacting the side of the chimney opposite to the scraper; (d) a device for enabling the distance between the scraper and the contact member to be adjusted; (e) a force applying member for causing a force to be applied between the scraper and the contact member; and (f) a handle attachment device for enabling the scraper and the contact member to be secured to a handle.

10 Claims, 2 Drawing Sheets

CHIMNEY CLEANING APPARATUS

FIELD OF THE INVENTION

This invention is directed to a novel apparatus which can be used for cleaning the interiors of fouled chimneys. More particularly, this novel apparatus can be adjusted to fit the interiors of various chimney sizes and shapes. The apparatus cleans not only soot but also tar and creosote from the interior of the chimney. The apparatus has a blade which contacts the side of the chimney at a constant angle, regardless of the size of the chimney, thereby facilitating the cleaning of creosote from the flue of the chimney.

BACKGROUND OF THE INVENTION

Conventional devices that are used for cleaning the interiors of soiled chimneys usually only effectively remove the soot but leave the majority of the tar and creosote in the chimney. Tar and creosote buildup in the chimney is dangerous because it causes a potential fire hazard. Both tar and creosote are inflammable at high temperatures.

A number of devices and apparatus have been invented in the past for the purpose of cleaning the interiors of soiled chimneys. The following patents disclose apparatus that are purportedly useful for cleaning chimneys.

| U.S. Pat. No. | U.S. Pat. No. |
|---|---|
| 195,445 | 2,455,001 |
| 1,230,310 | 4,090,271 |
| 1,392,202 | 4,333,200 |
| 1,582,309 | 4,490,879 |
| 1,615,733 | 4,492,000 |

Five of the located patents disclose chimney scrapers that have no ability to exert a force against the wall of the chimney. Specifically, they do not contain any spring device to maintain the scraper blade against the chimney wall. These patents are U.S. Pat. Nos. 195,445; 2,455,001; 4,090,271; and 4,490,879.

Five other U.S. patents, namely U.S. Pat. Nos. 1,392,202, 1,582,309, 1,615,733, 4,333,200 and 4,492,000, disclose chimney scrapers containing springs but they do not contain any mechanism to adjust the lateral force applied by the spring. Two of the patents, U.S. Pat. Nos. 4,492,000 and 1,392,202, use the contraction force of a spring to apply a lateral force. U.S. Pat. Nos. 1,582,309 and 1,615,733 use spring expansion force for this purpose. These devices do not maintain the blade at an angle optimum for cleaning difficult creosote.

Most of the above patents (except U.S. Pat. No. 1,230,310 and 2,445,001) disclose two blades, one on either side of the scraper, for cleaning opposite sides of the chimney simultaneously.

U.S. Pat. No. 1,230,310 issued June 19, 1917 to S. T. MacDonald for a chimney cleaner. MacDonald discloses means for applying a lateral force to a single scraper blade through the use of an adjustable spring mechanism. The blades do not maintain the optimum creosote cleaning angle.

MacDonald appears to use rotational torsion force exerted by a spring when it is twisted, rather than longitudinal deformation to apply the force. The adjustment mechanism in MacDonald does not directly adjust the rotational torsion force exerted by the spring MacDonald adjusts the moment that the spring applies to the pressure arm by varying the distance between the spring pivot point and the pressure arm pivot point.

SUMMARY OF THE INVENTION

None of the patents discussed above disclose a mechanism which ensures that the scraper blade compacts the interior wall of the chimney at an optimum scraping angle, regardless of chimney size.

A device for cleaning the interior of a chimney comprising: (a) scraping means for contacting and scraping the side of the chimney; (b) contacting means for contacting the side of the chimney opposite to the scraping means; (c) means for enabling the distance between the scraping means and the contacting means to be adjusted; (d) force applying means for causing a force to be applied between the scraping means and the contacting means; and (e) means for enabling the scraping means and the contacting means to be secured to a handle.

In the device, the force applying means may be a spring. The means for enabling distance adjustment between the scraping means and the contacting means may be a threaded bolt. The spring may be a coil spring associated with a rod extending between the scraping means and the contacting means. No matter what force is applied, the scraper blade remains at an optimum creosote cleaning angle.

In the device, the scraping means may be an elongated blade which is secured to a rod which is attached pivotally to the contacting means. The distance adjustment means may include a means for indicating the distance setting that should be made to correspond with the width of the chimney to be cleaned. The blade may be linear or curved. The device is designed so that it maintains the scraper blade at an optimum scraping angle regardless of the chimney width setting of the device.

DRAWINGS

In the drawings which depict a specific embodiment of the invention but which should not be construed as restricting the spirit or scope of the invention in any way:

DETAILED DESCRIPTION OF A SPECIFIC EMBODIMENT OF THE INVENTION

This invention pertains to a manually operable device for cleaning the interiors of chimneys of soot, tar and creosote. The device is designed so that a bolt and an activated spring cooperate with the arms of the device to hold the blade of the device at an optimum angle and pressure inside the chimney to thereby remove not only the soot but also the tar and the creosote from the interior of the chimney. The device can be fitted with either a flat or a curved blade thus enabling the device to clean round, square or even rectangular chimneys.

Figure 1:
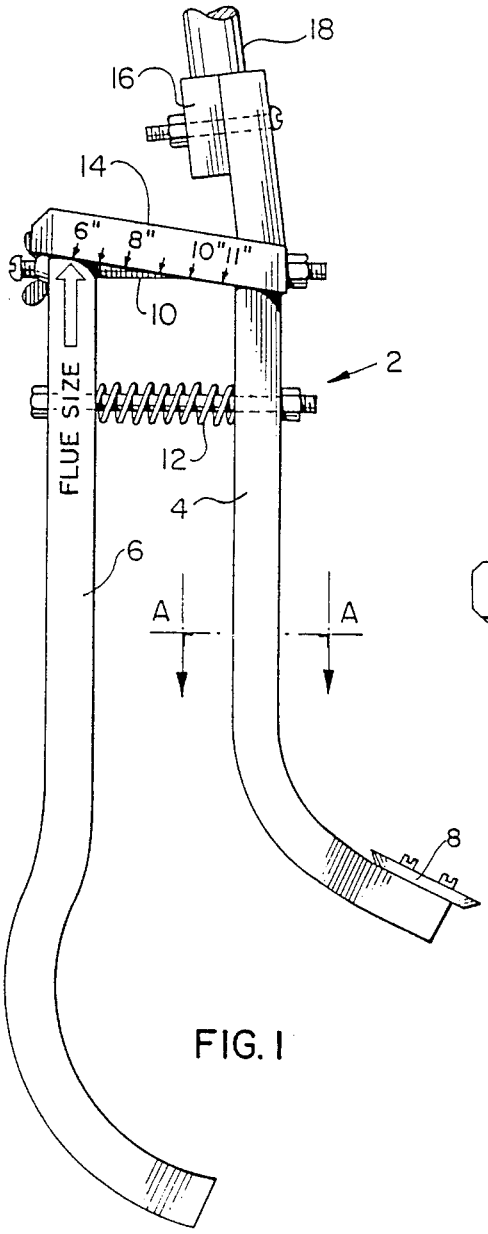
FIG. 1 depicts a side elevation view of the chimney cleaning device.
Figure 2:
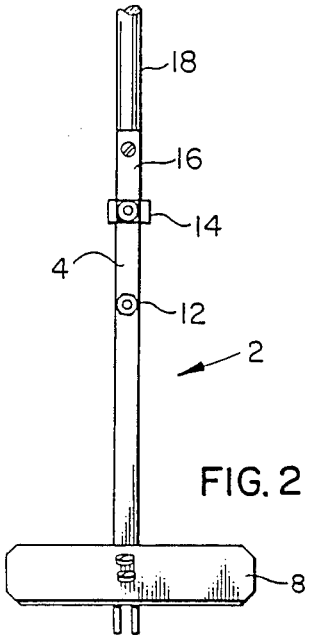
FIG. 2 depicts an end elevation view of the chimney cleaning device.
Figure 3:
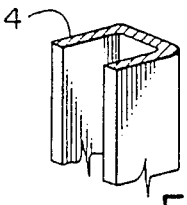
FIG. 3 depicts a cross-section view taken along setion line A—A of FIG. 1.

Referring to the drawings and FIG. 1 in the first instance, it can be seen that the device 2 is comprised of two bent sections of channel, a forward channel 4 which has a blade 8 secured to the end thereof thereof and a rear channel 6. The two channels 4 and 6 are generally parallel to one another and are fastened by an adjusting screw 10 which enables various chimney sizes to be accommodated. A spring 12 extends between the two channels 4 and 6 and holds the blade 8 firmly against the inside of the chimney at a pre-determined angle and pressure according to chimney size. Once the chimney size to be cleaned is identified, the correct force setting is set on the indicator plate 14 by the adjusting screw 10.

The device 2 uses a spring 12 and a pressure adjustment mechanism 10 to predetermine the amount of lateral pressure that is to be exerted against the interior of the chimney by the cleaning blade 8. Various adjustments are available to accommodate different chimney sizes. The spring 12 is connected longitudinally between the rear channel 6 and the forward channel 4. One end of the spring 12 is attached at a mid-point to each channel 4 and 6. For larger chimneys, the adjustment mechanism 14 increases the longitudinal compression of the spring 12 thus proportionally increasing the spring expansion pressure.

Because of the manner of construction of the channels 4 and 6, and their intercooperation with the screw 10 and spring 12, the blade 8 is always maintained at the same optimum scraping angle, regardless of the chimney size setting of the device 2 and the force that is applied by spring 12.

The device 2 is secured by a coupling 16 to a long aluminum conduit 18 of desired length to enable the operator to pass the device 2 up and down the interior of the chimney so that it can be cleaned.

Figure 4:
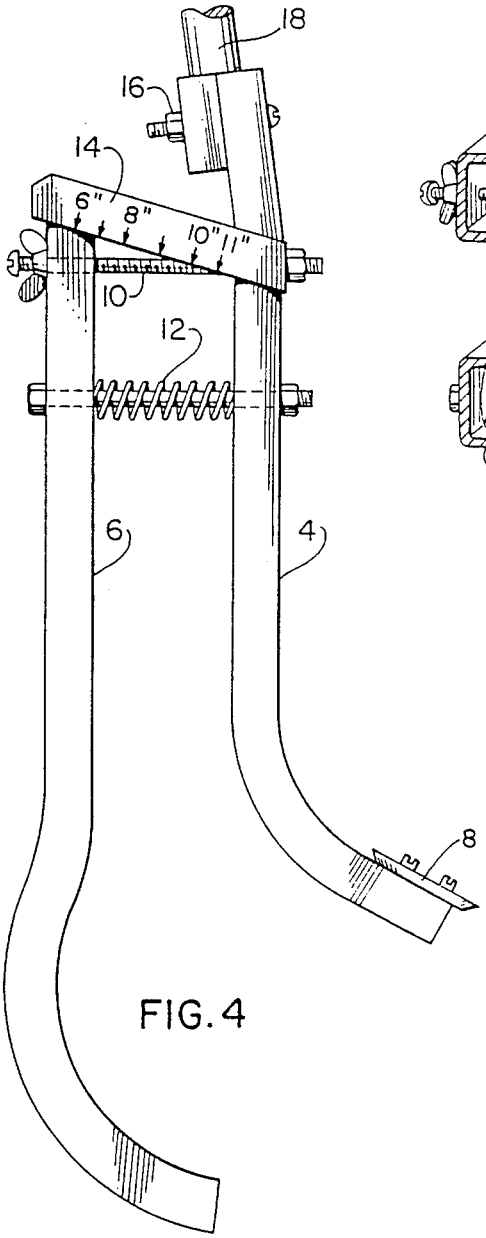
FIG. 4 depicts an alternative embodiment of the chimney cleaning device set at setting somewhat different from the embodiment shown in FIG. 1.
Figure 5:
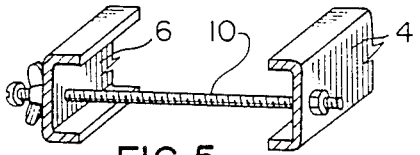
FIG. 5 depicts a partial section perspective view of the manner in which the setting bolt is secured to the arms of the chimney cleaning device.
Figure 6:
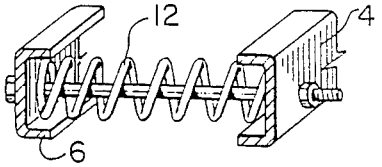
FIG. 6 depicts a partial section perspective view of the manner in which the compression spring cooperates with the arms of the chimney cleaning device.

FIG. 4 illustrates an alternative embodiment of the chimney cleaning device with curved channels set at setting somewhat different from the embodiment shown in FIG. 1. FIG. 5 illustrates a perspective view of the manner in which the setting bolt is secured to other arms of the chimney cleaning device. FIG. 6 illustrates a perspective view of the manner in which the compression spring cooperates with the arms of the chimney cleaning device.

The device 2 can be used by a homeowner, or by a professional chimney cleaner, to clean chimney flues. The operator stands on the roof of the building, sets on the indicator plate 14 the width of the device 2 to match the end width of the chimney flue to be cleaned, and then sends the device 2 down the flue. The scraper blade 8 located at the bottom end of the forward bent arm 4 is maintained at a constant optimum scraping angle relative to the chimney wall interior and scrapes soot, creosote and tar from that particular side of the flue. The opposite rear channel 6 stabilizes the device 2 as it travels down the chimney and applies an optimum force on the scraper blade 8 proportional to the width of the chimney. Once one or two passes are made down the flue, the operator then withdraws the device 2, reverses it and again sends it down the flue to clean the opposite side of the flue. The sides of the flue are cleaned by resetting the width of the device 2 to match the side width of the flue. The process is repeated as many times as is necessary in order to scrape all of the soot, tar and creosote from the interior of the chimney flue.

In certain cases, it may be useful to have two or more rear channels 6 backing up the forward channel 4. Likewise, in certain cases it may be advantageous to have the blade 8 carried by more than one forward channel 4. Linear or curved blades may be used depending upon the type of chimney that is to be cleaned.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A device for cleaning the interior of a chimney comprising:

(a) scraping means for contacting and scraping a side of the chimney;

(b) contacting means for contacting a side of the chimney opposite to the scraping means;

(c) means for enabling the distance between the scraping means and the contacting means to be adjusted;

(d) force applying means comprising a coil spring and an associated rod extending between the scraping means and the contacting means, for causing a force to be applied between the scraping means and the contacting means; and (e) means for enabling the scraping means and the contacting means to be secured to a handle.

2. A device as defined in claim 1 wherein the means for enabling distance adjustment between the scraping means and the contacting means is a threaded bolt.

3. A device as defined in claims 1 or 2 wherein the angle of the scraping means relative to the chimney interior is constant, regardless of the adjustment distance between the scraping means and the contacting means.

4. A device as defined in claim 2 wherein the distance adjustment means includes a means for indicating the distance setting that should be made to correspond with the width of the chimney to be cleaned.

5. A device as defined in claim 1 wherein the scraping means is an elongated blade which is secured to a rod which is attached pivotally to the contacting means.

6. A device as defined in claim 5 wherein the blade is linear.

7. A device as defined in claim 5 wherein the blade is curved.

8. A device as defined in claims 7, 8 or 9 wherein the angle of the scraping means relative to the chimney interior is constant, regardless of the adjustment distance between the scraping means and the contacting means.

9. A device for cleaning the interior of a chimney comprising:

(a) scraping means for contacting and scraping a side of the chimney;

(b) contacting means for contacting a side of the chimney opposite to the scraping means;

(c) adjustment means for adjusting the distance between the scraping means and the contacting means; and (d) force applying means for applying an expansion force between the scraping means and the contacting means which increases in response to an increase in the distance between the scraping means and the contacting means.

10. The device of claim 1 wherein:

the scraping means comprises a first longitudinal member and a blade carried on the first member;

the contacting means comprises a second longitudinal member having a curved end;

the adjustment enabling means comprises a threaded nut and a threaded bolt interconnecting the first and second longitudinal members;

the rod of the force applying means interconnects the first and second members at a position displaced from the threaded bolt of the adjustment enabling means; and the coil spring of the force applying means is carried on the rod between the first and second members so that each end of the coil spring is positioned to engage one of the first and second members.

* * * * *